United States Patent [19]

Raghavan et al.

[11] Patent Number: 4,998,113

[45] Date of Patent: Mar. 5, 1991

[54] NESTED HORN RADIATOR ASSEMBLY

[75] Inventors: Krishnan Raghavan, Redondo Beach; Gary J. Gawlas, Culver City; Paramjit S. Bains, Los Angeles, all of Calif.

[73] Assignee: Hughes Aircraft Company, Los Angeles, Calif.

[21] Appl. No.: 370,659

[22] Filed: Jun. 23, 1989

[51] Int. Cl.[5] ..... H01Q 13/02

[52] U.S. Cl. ..... 343/776; 343/786

[58] Field of Search ..... 343/772, 786, 776

[56] References Cited

U.S. PATENT DOCUMENTS

| | | | |
|---|---|---|---|
| 2,425,488 | 8/1947 | Peterson et al. | 343/776 |
| 3,566,309 | 2/1971 | Ajioka | 343/786 |
| 4,489,331 | 12/1984 | Salvat et al. | 343/753 |
| 4,740,795 | 4/1988 | Seavey | 343/786 |

*Primary Examiner*—Michael C. Wimer

*Attorney, Agent, or Firm*—Steven M. Mitchell; Robert A. Westerlund; Wanda K. Denson-Low

[57] ABSTRACT

A horn radiator assembly includes two horn radiators each of which is formed as a conical horn and a waveguide of constant cross section connected to the small end of the horn as a feed and providing a signal port. The first of the horn radiators is of relatively large cross section and serves to radiate electromagnetic waves at a relatively low frequency. The second of the horn radiators is of relatively small cross section and serves to radiate electromagnetic waves at a relatively high frequency. The second radiator is nested within the first radiator, and is positioned with its radiating aperture coplanar with the radiating aperture of the first radiator. In the second radiator, the waveguide feed is provided with a bend allowing the waveguide feed to pass through a wall of the first radiator. A strut may be affixed to the bend to provide a symmetrical transverse support within the first radiator for the second radiator. A doubly-tapered electrically conductive sheet extends from an apex within the throat of the first radiator horn to the transverse support, and from there tapers back to contact the horn of the second radiator. The tapered sheet guides low-frequency radiation past the strut and the bend to minimize standing wave ratio.

7 Claims, 4 Drawing Sheets

NESTED HORN RADIATOR ASSEMBLY

BACKGROUND OF THE INVENTION

This invention relates to the radiation of electromagnetic power from an assembly of horn radiators operating at different frequency bands and, more particularly, to an assembly of horn radiators wherein a radiator operating at a higher frequency operation is nested within a radiator operating at a lower frequency of radiation.

In communication systems, such as in systems employing a satellite for the communication of signals to various parts of the earth, it is common practice to employ an antenna system comprising a reflector and an array of radiators positioned for illuminating the reflector. Such an antenna system is well suited for the generation of a fan beam which can be directed to a geographical section of the earth. As an example of the construction of such an antenna system, it is common practice to construct the radiators in the form of horn radiators. Signals transmitted by the antenna system may be in one frequency band, while signals received by the antenna system may be in a different frequency band.

A situation of particular interest involves the generation of a spot beam in a high frequency band concurrently with the generation of a broad beam at a low frequency band. While it has been the practice, in many situations, to use a separate set of radiators and separate reflectors for generation of beams at high and at low frequency bands, in the present situation of interest, it is desired to locate the radiator of the spot beam concentric with a radiator of the low frequency band, and to use the same reflector for both the beams of the high and the low frequency radiations.

A problem arises in the colocating of a high frequency horn radiator with a low frequency horn radiator in that one of the horns may provide blockage of the other horn, or may otherwise interfere with the radiation characteristics of the other horn. Thus, in the foregoing situation of interest, there is a requirement to illuminate a single reflector with radiations at two different frequency bands from two radiators which are colocated. However, heretofore, no satisfactory antenna system for horn radiators has been available.

SUMMARY OF THE INVENTION

The foregoing problem is overcome and other advantages are provided by a horn radiator assembly constructed, in accordance with the invention, with two horn radiators. One of the horn radiators is adapted to radiate at a lower frequency band and the second of the horn radiators is adapted to radiate at a higher frequency band. Each of the horn radiators has an input port for receiving electromagnetic power from a transmitter, and a radiating aperture from which microwave signals are radiated to illuminate a common reflector. The second of the horn radiators, which operates at the higher frequency band, is smaller than the first radiator which operates at the lower frequency band. In accordance with an important feature of the invention, the smaller higher-frequency horn radiator is nested within the larger lower-frequency horn radiator in a manner which permits the lower frequency horn radiator to operate with no more than a negligible interference with its radiation characteristics from the presence of the higher frequency horn radiator.

It is recognized that the insertion of the second radiator within the first radiator introduces a physical structure which may serve as a reflector of energy at the lower frequency. Resulting reflections would increase the standing wave ratio within the first radiator and lower the efficiency of signal transmission. Such sources of reflection include supporting structure employed for holding the second radiator at a designated location within the first radiator, as well as the presence of a feed section of waveguide which conveys microwave energy from a transmitter to the second radiator.

In accordance with the invention, the foregoing structural components which can serve as reflectors are enclosed within a tapered electrically-conductive sheet. such as a metallic pyramid. A configuration of tapered sheet is employed on both sides of the reflectors to guide traveling waves, in either a transmission direction or in a reception direction, past the reflectors without interaction with the reflectors. Tapering allows for a smooth transmission within the first horn radiator so as to preserve a low standing wave ratio, and thereby retain the radiation characteristics of the first horn radiator, even though the second horn radiator is nested therein.

Thereby, the horn radiator assembly of the invention enables two horns, operating in different frequency bands and having different sizes to be colocated for illumination of a common reflector. The horn radiator assembly of the invention is reciprocal in operation so as to provide the foregoing benefit both in the case of a transmitted beam and a received beam of electromagnetic power. The input port for signal transmission becomes an output port during reception of a signal.

BRIEF DESCRIPTION OF THE DRAWING

The foregoing aspects and other features of the invention are explained in the following description, taken in connection with the accompanying drawing wherein.

DETAILED DESCRIPTION

Figure 1:
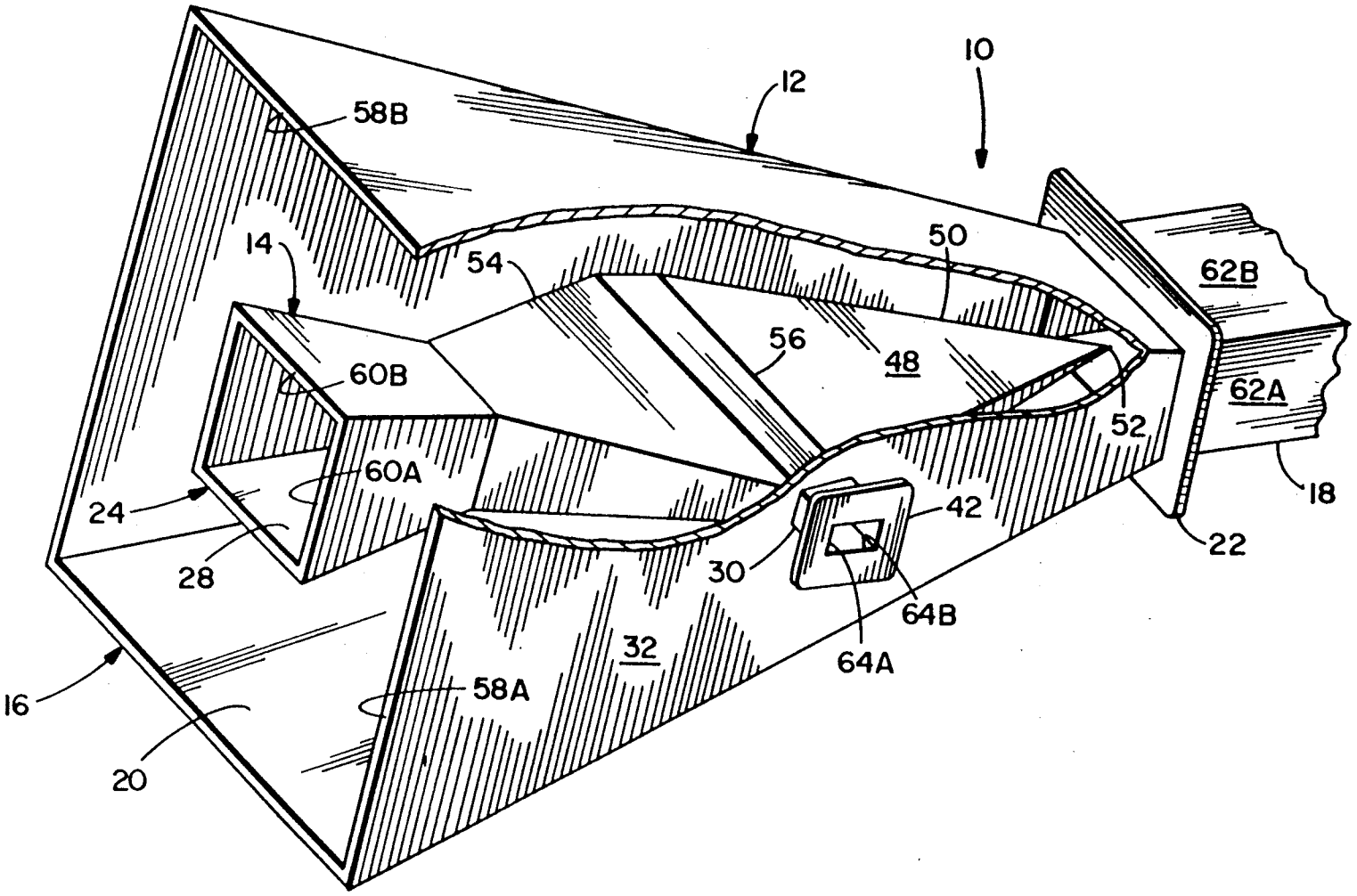
FIG. 1 is a perspective view of the horn assembly of the invention showing both a large outer radiator and a smaller inner radiator, a horn of the large radiator being partially cutaway to show a sheet structure for guiding radiation past a feed waveguide for the smaller radiator.
Figure 2:
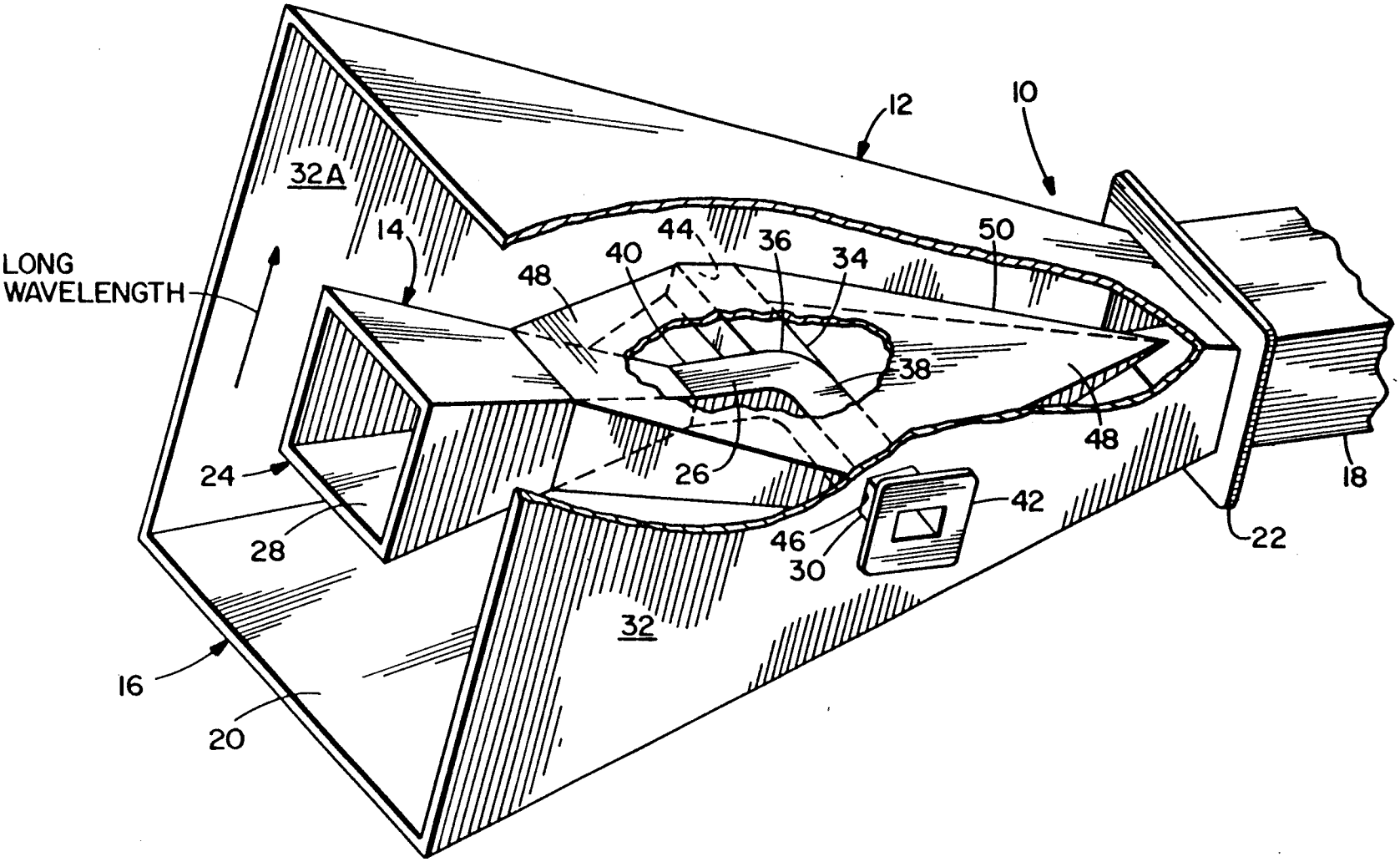
FIG. 2 shows the structure of FIG. 1, with the sheet structure being partially cutaway to show a bent waveguide feed of the smaller radiator.

With reference to FIGS. 1 and 2, there is shown a horn assembly 10 which is constructed in accordance with the invention and include a relatively large low-frequency horn radiator 12 and a relatively small high-frequency horn radiator 14 disposed within the large radiator 12. By way of example in the construction of a preferred embodiment of the invention, the large radiator 12 operates at C-band microwave frequencies, 4–6 GHz (gigahertz), and the small radiator 14 operates at Ku band, 12–18.5 GHz.

The dimensions of the components of the horn assembly 10, as disclosed herein, are intended for use in a frequency range of 3.7–4.2 GHz and 12.25–14.75 GHz for the radiators 12 and 14, respectively. The principles of the invention are applicable to radiators constructed for operation for frequencies other than the foregoing frequencies.

The large radiator 12 includes a diverging portion, to be referred to as a horn 16 and a section of waveguide of constant cross-sectional dimensions to be referred to as a throat 18. The throat 18 extends from the end of the horn 16 having a relatively small cross section while the opposite end of the horn 16 having a relatively large cross section serves as a radiating aperture 20 of the large radiator 12. In the construction of the large radiator 12, the throat 18 and the horn 16 may be formed as a unitary structure, as by braising the waveguide of the throat 18 to the small end of the horn 16.

Alternatively, as shown in FIGS. 1 and 2, the throat 18 may be secured to the horn 16 by means of a mounting flange 22. The construction of the small radiator 14 is substantially the same as that of the large radiator 12, the small radiator 14 having a horn 24 and a throat 26 (FIG. 2) connected to the small end of the horn 24. The large end of the horn 24, opposite the throat 26, serves as a radiating aperture 28 of the small radiator 14. The throat 26 and the horn 24 are formed as a unitary structure by braising the throat 26 to the horn 24. The radiators 12 and 14 are formed of a metal, such as brass or aluminum.

In the construction of the invention, it is noted that the horns 16 and 24 have rectangular cross section, as do the throats 18 and 26. However, the principles of the invention apply to horn radiators of other cross section, such as circular cross section. Furthermore, while the horns 16 and 24 are disclosed as being tapered structures, it is noted that the principles of the invention also apply to a non-tapered horn such as an open-ended waveguide of constant cross section. In a preferred embodiment of the horn assembly 10, as depicted in FIGS. 1 and 2, the radiating apertures 20 and 28 are coplanar. However, if desired, the horn 24 of the small radiator 14 can be positioned such that its radiating aperture 28 is located forward of the radiating aperture 20 (outside the horn 16), or behind the radiating aperture 20 (inside the horn 16).

In the construction of the horn assembly 10, the radiation patterns of the large radiator 12 are predicted by numerically integrating the modal fields existing over its aperture, and assuming the electric and magnetic fields to be of zero amplitude over the region of the horn 16 which is blocked by the horn 24. This enables optimization of the position of the horn 24 of the small radiator 14, and also enables accurate prediction of the gain, as well as the co-polar and cross-polar radiation patterns of the large radiator 12.

It is advantageous to construct the horn assembly 10 with symmetry in the mounting of the horn 24 within the horn 16. This is accomplished by bending the throat 26 of the small radiator 14 so that a distal end 30 thereof protrudes through a wall section 32 of the large horn 16 so as to provide physical contact with the wall section 32 for supporting the small radiator 14 within the horn 16. Protrusion of the distal end 30 of the throat 26 through the wall section 32 also provides a signal port for access to the small radiator 14 for applying electromagnetic signals to be radiated from the horn 24. A strut 34, which may be fabricated as a section of dummy waveguide is secured to the throat 26 at a bend 36 of the throat 26, and extends parallel to a distal leg 38 of the throat 26 and perpendicular to a proximal leg 40 of the throat 26. Center lines of the strut 34 and of the legs 38 and 40 are coplanar. The strut 34 and the distal leg 38 form a brace which extends transversely of both the horns 16 and 24, and contacts opposed wall sections 32 of the horn 16 to provide for a symmetrical mounting of the horn 24 within the horn 16.

By way of example in the fabrication of the foregoing brace, the strut 34 may be brazed to the bend 36 of the throat 26. A mounting flange 42 is brazed to the distal end 30 of the throat 26 to facilitate a connection of microwave circuitry to the small radiator 14 so as to provide a microwave signal to be transmitted by the small radiator 14, or for receiving incoming microwave signals incident upon the radiating aperture 28 of the small radiator 14. In similar fashion, a flange (not shown) may be secured to a distal end of the throat 18 for connection of microwave circuitry to the large radiator 12. The strut 34 may be secured to a wall section 32A by passing an end of the strut 34 through an aperture 44 in the wall section 32A, and then brazing the end of the strut 34 to the wall section 32A. Similarly, the distal leg 38 may be secured to the wall section 32 at an aperture 46 in the wall section 32. The horn 24 is positioned symmetrically within the horn 16, center lines of the two horns coinciding. During manufacture of the assembly 10, the wall sections 32 and 32A may be bowed outward slightly to clear ends of the strut 34 and the throat 26 to allow insertion within the horn 16 and emplacement in the apertures 44 and 46.

It is recognized that the strut 34 and the throat 26 constitute a physical structure which can readily reflect waves of radiation propagating through the large radiator 12. Reflections of the radiation are undesirable because they decrease the effectiveness of transmission of microwave power through the large radiator 12 as is indicated by an increased value of standing wave ratio produced by such reflection. In order to operate the horn assembly 10 effectively, it is desirable that the respective radiant signals in both of the radiators 12 and 14 be allowed to propagate without interference from the microwave structures which guide the radiant signals. Accordingly, in accordance with a feature of the invention, an electrically conductive sheet 48 is positioned within the large radiator 12 for enclosing the strut 34 and the throat 26 so as to guide the lower frequency radiation within the large radiator 12 past the region of a strut 34 and the throat 26 without reflection from these components. By way of example, the sheet 48 may be constructed of copper foil or aluminum foil, the foil being sufficiently thick to provide for dimensional stability. The sheet 48 is folded so as to provide the configuration of a double taper. One taper directed towards the throat 18 produces a cone or pyramid 50 having an apex 52. Towards the forward end of the horn 16, the sheet 48 tapers in a tapered section 54 between forward edges of the strut 34 and the leg 38 to the four sides of the horn 24. The tapered section 54 comprises four trapezoidal wall sections. The aforementioned brace is formed as a composite of the strut 34 and the leg 38 and is indicated at 56 (FIG. 1) as an outline in the sheet 48 of the structure of the brace. In the region of the brace 56, the sheet 48 lies flat on the top and the bottom surfaces of the brace 56, with reference to the orientation of the assembly 10 presented in FIG. 1. Both behind the brace 56, and in front of the brace 56, the sheet 48 undergoes the aforementioned tapering at the pyramid 50 and at the tapered section 54, respectively.

The tapering of the sheet 48 provides for a gradual transition in the interior dimensions of the large radiator 12 so as to prevent the generation of excessive reflections. The sheet 48 accomplishes its function of allowing the large radiator 12 to function in a normal fashion, in spite of the presence of the small radiator 14. Thereby, the horn assembly 10 can provide for the co-location of the high and the low frequency radiating apertures in a compact physical configuration while retaining the radiation characteristics of the individual radiator 12 and 14.

The following dimensions are employed in constructing the preferred embodiment of the horn assembly 10. With reference to FIG. 1, in the horn 16, the sides 58A and 58B of the radiating aperture 20 each measure 6.0 inches. In the horn 24, the sides 60A and 60B of the radiating aperture 28 measure, respectively, 1.8 inches and 2.2 inches. In the throat 18 of the large radiator 12, the widths of the sides 62A and 62B measure, respectively, 1.145 inches and 2.29 inches. In the waveguide of the throat 26 (FIG. 2) of the small radiator 14, the sides 64A and 64B measure, respectively, 0.375 inches and 0.75 inches. The length of the horn 16, as measured along its center line from the radiating aperture 20 to the flange 22, is 10.0 inches. The length of the horn 24, as measured along its center line from the radiating aperture 28 to the junction with the throat 26, is 4.0 inches. The angles of taper in the construction of the sheet 48, as measured with respect to a center line of the horn assembly 10, are preferably in the range of 15–20 degrees, though other angles of taper may be employed, if desired, in accordance with accepted practice in the design of microwave transition structures.

Figure 3:
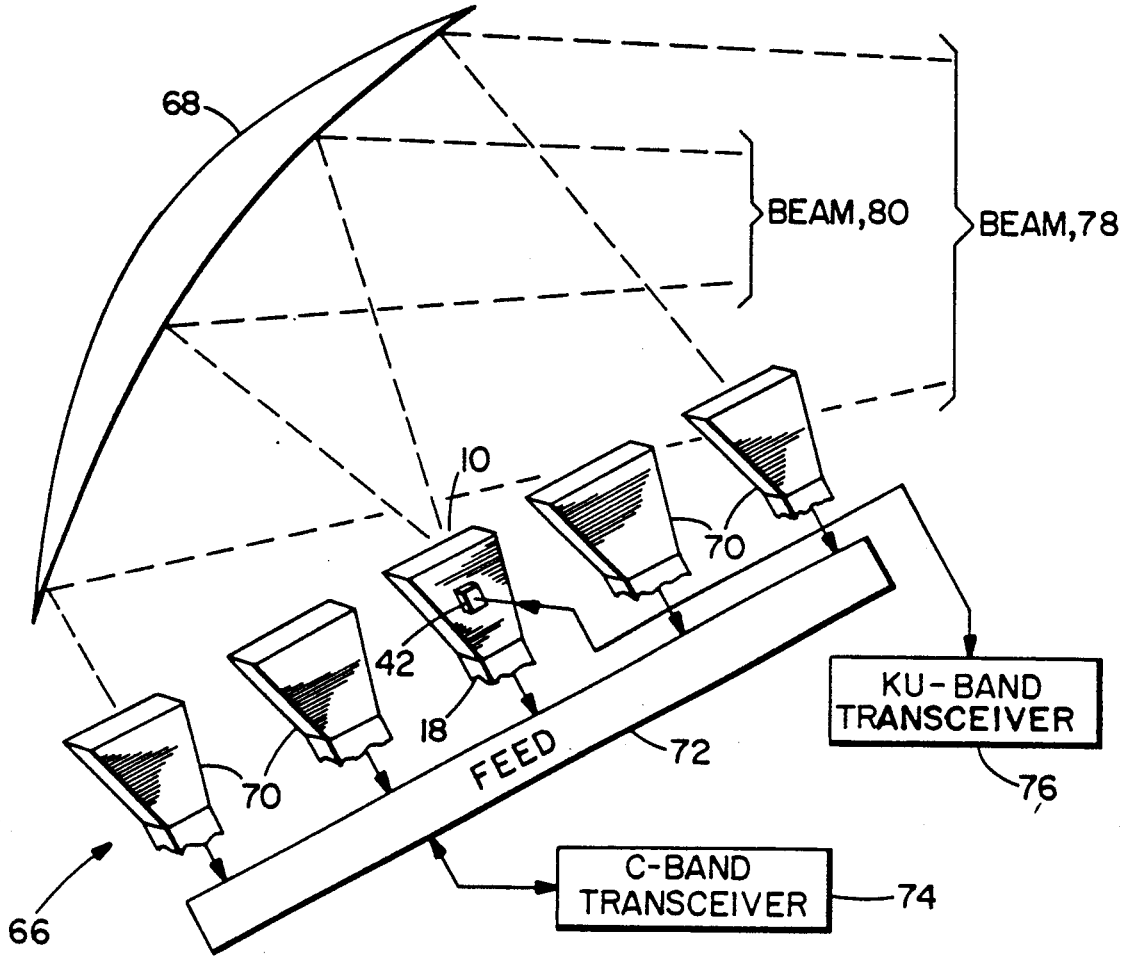
FIG. 3 shows an antenna system incorporating the horn assembly of the invention in an array of radiators.

FIG. 3 shows an antenna system 66 which is useful in demonstrating use of the horn assembly 10. The antenna system 66 comprises a reflector 68, a plurality of radiators 70 arranged in an array which includes the horn assembly 10, a feed unit 72 such as a power splitter or Butler matrix, a C-band transceiver 74 coupled to the feed unit 72, and a Ku-band transceiver 76 connected by the flange 42 to the small radiator 14 of the horn assembly 10. The feed unit 72 applies C-band microwave power to each of the radiators 70 and also via the throat 18 to the large radiator 12 of the horn assembly 10. Each of the radiators 70 and the large radiator 12 of the horn assembly 10 direct microwave power to the reflector 68 for forming a C-band beam 78 which is transmitted to a distant site. The antenna system operates in reciprocal fashion so that an incoming beam 78 of radiation provides microwave signals which are received by the transceiver 74.

Similarly, the small radiator 14 of the horn assembly 10 directs microwave signals from the transceiver 76 towards the reflector 78 for forming a Ku band beam 80. Since the antenna system 66 operates in reciprocal fashion, an incoming band 80 of Ku-band microwave signals is directed by the small radiator 14 of the horn assembly 10 to the transceiver 76. The beams 78 and 80 are concentric by virtue of the use of a common reflector 68 for both the C-band and the Ku-band radiation, and due to the fact that a center one of the radiators of the system 66 employs the invention in the form of the horn assembly 10. In FIG. 3, the radiators 70 are depicted as being horn radiators having the same configuration as the large radiator 12 of the horn assembly 10. However, if desired, the horn assembly 10 of the invention can be employed with radiators of other physical configuration.

Figure 4:
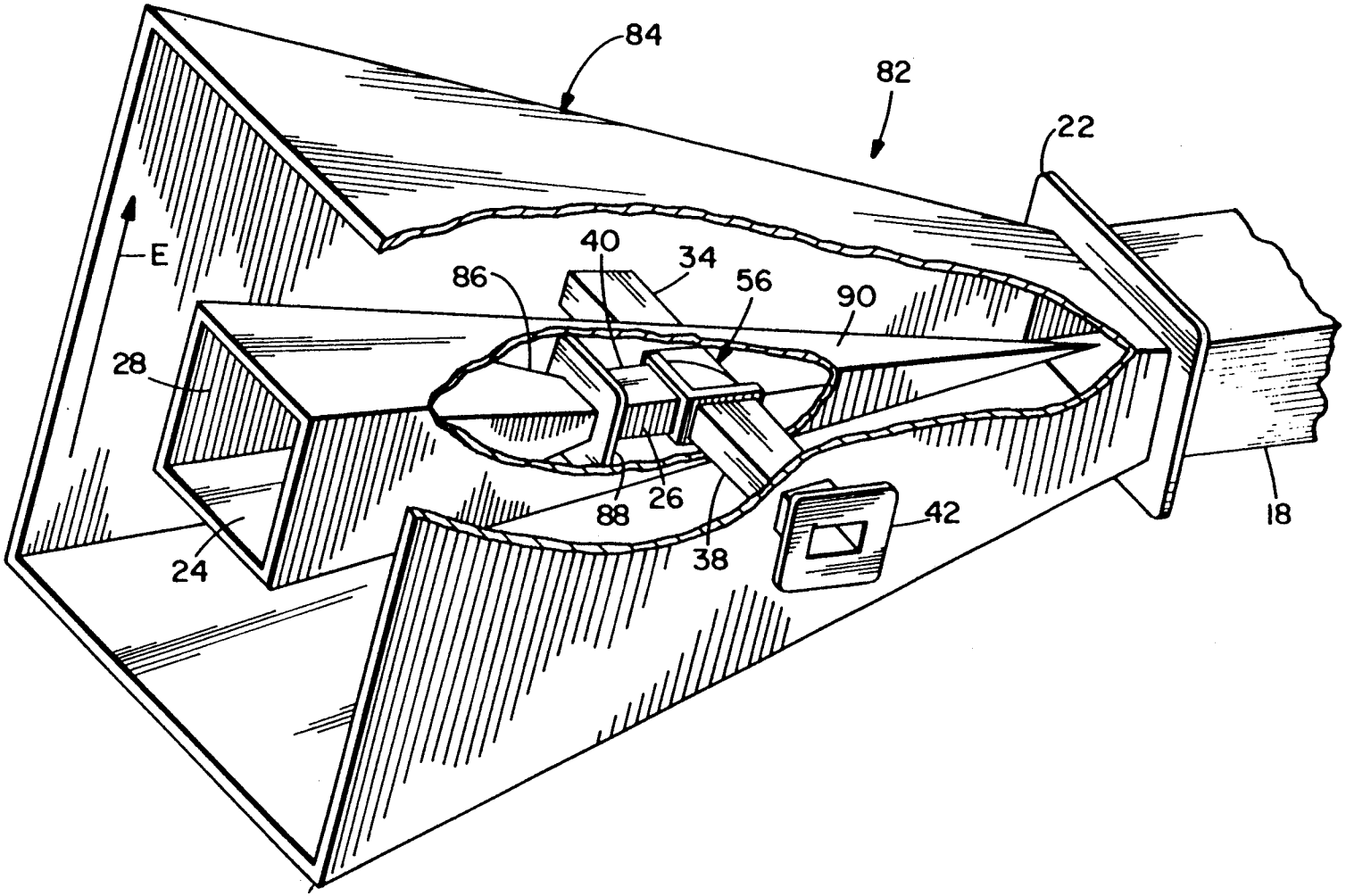
FIG. 4 shows the structure, generally, of FIG. 1 with a simplified sheet which is depicted partially cutaway to show the bent waveguide feed of the smaller radiator.

FIG. 4 shows a further embodiment of the invention which functions in the same manner as that disclosed in FIGS. 1 and 2, but is preferred because of its simpler construction. In FIG. 4, a horn assembly 82 comprises a large radiator 84 and a small radiator 86 nested within the large radiator 84 as was described in FIGS. 1 and 2 with reference to the radiators 12 and 14, respectively. The large radiator 84 has the same configuration as the radiator 12. The small radiator 86 comprises the horn 24 and the throat 26 of the radiator 14 but differs in construction from the radiator 14 in that the horn 24 is joined to the throat 26 by a flange 88 rather than by the unitary construction of the radiator 14. The strut 34 and the distal leg 38 of the throat 26 are joined together to form the brace 56 which is oriented transversely of the common axis of the horns 16 and 24 for securing the small radiator 14 to the large radiator 12.

In accordance with the invention, the horn assembly 82 includes a sheet 90 which encloses the horn 24, the proximal leg 40 of the throat 26, the flange 88, and the central portion of the brace 56. The sheet 90 functions in the same fashion and serves the same purpose as the sheet 48 (FIGS. 1 and 2). The sheet 90 has a simpler geometric form than the sheet 48, the sheet 90 being in the form of a simple pyramid which extends from a base at the radiating aperture 28 of the horn 14 to an apex at the flange 22 at the junction of the horn 16 with the throat 18 of the large radiator 12. Due to the simpler configuration of the sheet 90, the outer ends of the brace 56 extend through the sheet 90 to be exposed to the lower frequency radiation propagating within the large radiator 12. However, the resulting reflections of the electric field, E, of the lower frequency radiation may be regarded as being negligible because of the very small reflection of the electric field from the outer ends of the brace 56. The small amount of reflection is due to the presentation of the narrow wall of the distal leg to the radiation with the direction of the electric field, E, being perpendicular to the brace 56.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A horn radiator assembly comprising:

a first rectangular horn radiator and a second rectangular horn radiator, said second horn radiator being smaller in cross section than said first horn radiator and being located within said first horn radiator; and wherein said first radiator comprises a first enclosing wall structure of rectangular cross-section defining a first passage for propagation of a first radiation, said first passage terminating in a first signal port at a first end of said first wall structure and in a first radiating aperture at a second end of said first wall structure opposite said first end, said first wall structure having a first and a second pair of opposed walls;

said second radiator comprises a second enclosing wall structure of rectangular cross-section defining a second passage for propagation of a second radiation, said second passage terminating in a second signal port at a first end of said second wall structure and in a second radiating aperture at a second end of said second wall structure opposite said first end of said second wall structure;

at a location adjacent said second port, said second wall structure passes through said first wall structure allowing said second port to extend outside said first wall structure; and said radiator assembly further comprises sheet means configured with tapered surfaces to reduce a standing wave ratio of said first radiation by guiding said first radiation within said first horn radiator past at least a portion of said second wall structure between said second radiating aperture and said second port, said sheet means contacting said first pair of opposed walls of said first wall structure for part of the longitudinal extent of said sheet means and being spaced apart from said first pair of opposed walls of said first wall structure for the remainder of its extent, and said sheet means being spaced apart from said second pair of opposed walls of said first wall structure to provide space for propagation of said first radiation.

2. A radiator assembly according to claim 1 wherein said sheet means tapers to produce an apex facing said first signal port of said first radiator.

3. A radiator assembly according to claim 2 wherein, at an end of said sheet means opposite said apex, said sheet means terminates on said second wall structure at a location spaced from said second radiating aperture.

4. A horn radiator assembly comprising:

a first horn radiator and a second horn radiator, said second horn radiator being smaller in cross section than said first horn radiator and being located within said first horn radiator; and wherein said first radiator comprises a first enclosing wall structure forming a first horn and a first throat connecting with the first horn to define a first passage for propagation of a first radiation, said first passage terminating in a first signal port at a first end of said first wall structure and in a first radiating aperture at a second end of said first wall structure opposite said first end of said first wall structure;

said second radiator comprises a second enclosing wall structure forming a second horn and a second throat connecting with the second horn for defining a second passage for propagation of a second radiation, said second passage terminating in a second signal port at a first end of said second wall structure and in a second radiating aperture at a second end of said second wall structure opposite said first end of said second wall structure;

at a location adjacent said second port, said second throat passes through said first wall structure allowing said second port to extend outside said first wall structure; and said radiator assembly further comprises a strut for supporting said second radiator within said first radiator; and means for guiding radiation within said first horn radiator past said second throat to reduce a standing wave ratio of said first radiation; and wherein said guiding means comprises sheet means configured with tapered surfaces for covering said second throat to reduce the standing wave ratio of the first radiation;

a bent section of said second throat extends transversely of a longitudinal axis of said first radiator, and joins with a first wall section of said first horn for positioning said second radiator within said first radiator; and said strut extends from a bend in said second throat transversely to a second wall section of said first horn at a site diametrically opposite a site of a joining of said second throat with said first wall section of said first horn.

5. A radiator assembly according to claim 4 wherein said sheet means further encloses said strut.

6. A radiator assembly according to claim 5 wherein a tapering of said sheet means produces an apex facing said first port of said first radiator and, at an end of said sheet means opposite said apex, said sheet means terminates on said second wall structure at a site between said throat and said second radiating aperture.

7. A radiator assembly according to claim 6 wherein said sheet means terminates on an outer surface of said second horn.

* * * * *